United States Patent [19]

Jalon

[11] Patent Number: 4,736,425

[45] Date of Patent: Apr. 5, 1988

[54] SECURITY MARKING METHOD, MATERIALS PROVIDED WITH SECURITY MARKS

[75] Inventor: Michel Jalon, Paris, France

[73] Assignee: Petrel Company, Paris, France

[21] Appl. No.: 892,840

[22] Filed: Aug. 4, 1986

[30] Foreign Application Priority Data

Aug. 8, 1985 [FR] France ..... 85 12172

[51] Int. Cl.[4] ..... H04K 9/00; B42D 15/00

[52] U.S. Cl. ..... 380/59; 283/92

[58] Field of Search ..... 8/648; 235/491; 250/363, 365, 371; 283/75, 92, 94; 427/151; 380/59

[56] References Cited

U.S. PATENT DOCUMENTS

| | | | |
|---|---|---|---|
| 3,473,027 | 10/1969 | Freeman et al. | 250/365 |
| 4,105,333 | 8/1978 | Kaule et al. | 250/365 |
| 4,445,225 | 4/1984 | White | 250/271 |
| 4,451,521 | 5/1984 | Kaule et al. | 250/363 |
| 4,451,530 | 5/1984 | Kaule et al. | 250/365 |
| 4,463,970 | 8/1984 | Kaule et al. | 283/75 |
| 4,476,382 | 10/1984 | White | 235/491 |
| 4,602,264 | 7/1986 | Shoi et al. | 427/151 |
| 4,627,642 | 12/1986 | Peronneau et al. | 283/94 |
| 4,655,788 | 4/1987 | Jalon | 8/648 |

FOREIGN PATENT DOCUMENTS

| | | |
|---|---|---|
| 0066854 | 4/1985 | European Pat. Off. . |
| 516196 | 3/1966 | Switzerland . |

*Primary Examiner*—Salvatore Cangialosi

*Attorney, Agent, or Firm*—Finnegan, Henderson, Farabow, Garrett & Dunner

[57] ABSTRACT

The invention relates to fiduciary documents and liquids requiring an authentication and a method of marking.

The authentication is effected by producing a synthesis reaction of a fluorescent chelate in or on the materials to be authenticated.

11 Claims, No Drawings

SECURITY MARKING METHOD, MATERIALS PROVIDED WITH SECURITY MARKS

The present invention relates to markings of fiduciary documents, enabling these documents to be authenticated or identified under certain conditions, or of solutions requiring authentication.

As used here and in the following text, the expression "fiduciary documents" refers to security papers such as papers for bank-bills, checks, shares, securities, stamps, official documents, identity cards, passports, record documents, tickets, certificates, vouchers, reports, accountancy ledgers, and other similar papers required to have a high level of security and permitting subsequent authentication.

In the prior state of the art, numerous means have been used to mark such documents which subsequently, that is to say after the marking has been produced, enable the marked document to be authenticated; the use of fibers, threads, chips, fluorescent platelets and particles, watermarks and fluorescent or phosphorescent inks may be mentioned, for example.

The use of dyes which change from a colorless state to a colored state in the presence of acidic, basic or alcoholic solutions, may also be mentioned.

In the case of such markings, the identification is generally made by fairly simple technical means such as grazing, illumination, Wood's lamps and the like.

However, such markings have the disadvantage of being permanent, and the well-informed forger, who has access to these technical means for revealing such markings, will therefore be aware of the markings to be imitated.

Those markings which rely on changes in the state of reactive dyes also have the disadvantage of being readily discovered by the forgers because the possible reactions of a change of state of these dyes are very limited in number.

It thus appears desirable to have access to methods of marking of which the forger cannot be aware when inspecting the document, because, firstly, this marking is invisible, whereas the person responsible for authenticating or identifying will know to cause this marking to become visible, because, secondly, this marking can be deactivated after its development by the person authorized to do so, and because, thirdly, the correct reaction for developing the marking will be very difficult to discover, having to be chosen from a very large number of possibilities.

The present invention offers such a level of security by, on the one hand, adopting a two-step marking method, and, on the other hand, by making use of the properties of chelates.

The first step of the marking is a premarking which is done when the document is produced; the second step is the development of the marking, which may take place several months or several years after the first step. There may be added to this a third step which is the disappearance of the developed marking, in order not to attract the attention of the forgers.

This marking method makes use of the properties of chelates, which have the advantage, under excitation by ultraviolet rays, of being fluorescent in a spectral region ranging from the ultraviolet to the infrared, depending on the metal ions employed.

In the first step of the marking, one or more of the elements which form the chelate is or are deposited in or on the security paper, these elements being chosen so that the chelate is not formed in this first step.

In the second step, the development is carried out by forming the chelate in or on the paper, that is to say by depositing thereon the missing element(s), and this produces the synthesis of the chelate in this second step.

The chelate formation is thus produced only at the time of the identification.

Thus, for example, it is possible to deposit the ligand(s) in the first step, and the metal ion(s) in the form of chlorides or nitrates in the second step, or vice versa, care being taken that the deposited solutions are adjusted in respect of their pH to the fluorescence pH of the chelate(s) to be formed.

The molar ratios of the ligand to the metal ion depend on the chelate to be formed, but in all cases there must be a significant excess of the ligand; with some ligand/-metal ion combinations fluorescence may be obtained in the second step of the marking with only traces of metal ions.

In the first step, one or more of the elements forming the chelate is or are deposited as an aqueous or alcoholic solution in or on the security paper, either at the head of the papermaking machine, or during the coating, or at any other stage during its manufacture or its finishing. The deposit of this or these chelate-forming element(s) does not alter the color of the paper and does not exhibit any fluorescence.

In the second step, the missing element(s) is or are added to the paper by means of an aqueous or alcoholic deposition, using any means whatever: printing, brush, stamp, fountain pen, felt-tip pen, or other. The chelate synthesized in this manner is an identification mark which is invisible in sunlight or under artificial light, and is visible owing to its fluorescent emission in the U.V., the visible or the I.R. only under excitation by ultraviolet rays.

In the third step, this marking, already invisible in sunlight or under artificial light, may also again become invisible under excitation by U.V. rays when the fluorescence of the chelate is deactivated, a deactivation produced by depositing on the spot authenticated by the fluorescent chelate an acidic or alkaline solution using anyone of the means described are used for the second step.

The chelates to be formed may be formed with metals or metalloids, and rare-earth chelates are especially advantageous.

The security of such a method of marking lies, inter alia, in the fact that the chelates formed in this way and having the property of being fluorescent, are the result of given combinations between certain ligands and certain metal or metalloid ions.

In point of fact, among the very many theoretically possible combinations, only some make it possible to obtain a chelate which fluoresces and whose fluorescence spectrum is typical of this combination. As a result, since combinations are involved, these combinations are difficult to recognise and hence to imitate, even by the informed forger, who will not know which ligand-ion combination he ought to imitate in the case of a particular security paper to be imitated.

Proof of forgery, furthermore, will be readily applied either because the second step of the marking will not give rise to the formation of a fluorescent chelate on the forged document, since the correct combination has not been followed, or because the fluorescence of the chelate produced in the second step will not have given the expected fluorescence spectrum, the correct combination not having been followed in this case either.

The following examples illustrate the invention without implying any limination and will enable it to be better understood.

EXAMPLE 1

In the course of the manufacture of a security paper, an alcoholic coating solution containing 4 moles/liter of acetylacetone and 4 moles/liter of pyridine was deposited. This paper showed no trace of this first step of marking when dried and cut into check format.

After the check was printed and finished, its authentication was carried out by using a felt-tip pen filled with an aqueous solution of terbium chloride at a concentration of 1 mole/liter. The felt-tip pen line, causing the terbium chelate to be synthesized, constituted an authentication by developing a green fluorescence, typical of this chelate, on the paper when excited by ultraviolet rays. On the other hand, this line was invisible in normal light.

After performing this second step of the marking of the invention, the third step was carried out: a dilute hydrochloric acid solution at a concentration of 1 mole/liter was spread with a brush on the fluorescent line and hence on the chelate, and this caused the fluorescence of the chelate under U.V. to disappear; after this third step this security paper no longer contained any trace of its identification possibilities.

EXAMPLES 2 TO 8

By following the principle of Example 1, the following elements were deposited in this way:

| | First step | 2nd step | 3rd step |
|---|---|---|---|
| EX. 2 | acetylacetone | europium nitrate and aqueous ammonia | HCl |
| EX. 3 | $SmCl_3$ | acetylacetone and NaOH | $H_2SO_4$ |
| EX. 4 | NaOH | acetylacetone and $TbCl_3$ | HCl |
| EX. 5 | benzoylacetone and pyridine | $NdCl_3$ | HCl |
| EX. 6 | benzylamine and $TbCl^3$ | salicylic acid | NaOH |
| EX. 7 | acetylacetone and 1,10-phenanthroline and aqueous ammonia | $TbCl_3$ | NaOH |
| EX. 8 | benzoylacetone and $DyCl_3$ | NaOH | HCl |

EXAMPLE 9

4 separate solutions of $EuCl_3$, $TbCl_3$, NdClhd 3 and $SmCl_3$ were deposited in the paper for a lottery ticket by means of 4 inking rollers, each containing one of these 4 solutions; the printing of the 4 rollers was horizontal and the 4 strip deposits were one centimeter apart from one another.

When the authentication of the lottery ticket was checked, a vertical line was drawn, thus intersecting the 4 horizontal strips, with a pen of the felt-tip type containing an alcoholic solution of sodium benzoylacetonate. This vertical line gave rise to the simultaneous synthesis of 4 different chelates in the lotter ticket, and, by means of their combinations and their arrangements, the 4 fluorescence emissions excited by the U.V. rays made possible a very secure authentication due to this coding resulting from the synthesis of the chelates on the paper.

EXAMPLE 10

In the course of the manufacture of a security paper, an aqueous coating solution containing 4 moles/liter of 8-hydroxyquinoline-5-sulfonic acid dihydrate was deposited and dried, and then this paper was cut into a check format. The method of Example 1 was used to carry out its authentication by using a felt-tip pen filled with an aqueous solution of aluminum nitrate (0.0005 mole/l), and a chelate which fluoresced in yellow-green was obtained.

EXAMPLE 11

8-hydroxyquinoline (0.004 mole) was dissolved in a perfume of a well-known make to produce the first step of the marking; in order to distinguish it subsequently from an imitation perfume, the true perfume was authenticated and distinguished by incorporating therein magnesium chloride (0.0005 mole) in an alcoholic phase, thus giving rise to the synthesis of a chelate fluorescing in yellow-green.

EXAMPLE 12

The components of Example 11 were used again, but were applied to heliographic ink for fiduciary use.

In order to obtain a highly secure authentication, use may be made of the capabilities of analysis of the emission spectra of chelate fluorescence. Thus, a fiduciary document which is authenticated simultaneously by the combination of 8-hydroxyquinoline-5-sulfonic acid and aluminum nitrate, and the combination of the sodium salt of salicylic acid and terbium chloride, these two chelates being fluorescent in yellow-green, an inspection of the fluorescence spectra of the marked regions permits a highly secure authentication by distinguishing between the two spectra, a broad band spectrum in the case of the aluminum chelate and a narrow band spectrum in the case of the terbium chelate.

The invention is obviously not limited to the examples of embodiment and other examples of embodiment and of application may be foreseen without departing from the scope of the invention.

I claim:

1. A method of marking fiduciary documents and liquids requiring authentication marks by the use of the fluorescent properties of chelates comprising the steps of:

(a) introducing only a part of the elements forming at least one chelate into or onto the materials to be marked, (b) incorporating the missing part of the elements forming the chelate in or on the materials to be authenticated to effect the synthesis of the fluorescent chelate, and (c) adding an acid or a base into or onto the marked materials to cause the fluorescence of the identifying chelates to disappear.

2. Method of marking as claimed in claim 1, wherein the incorporation in the first step of the marking of only a part of the elements forming the chelate does not modify the color of the material and does not fluoresce.

3. Method of marking as claimed in claim 2, wherein the chemical reaction(s) produced at the time of the authentication constitute a coding of the authenticated materials by means of the arrangement of their regions of fluorescent emission and by means of their emission spectra.

4. Method of marking as claimed in claim 3, wherein the marking is produced using ligand-rare earths combinations.

5. Method of marking produced as claimed in one of claims 1 to 4, wherein the marking using rare-earth chelates and chelates of other ions, simultaneously is authenticated by comparing the narrow band emission spectra in the case of the rare-earth chelates and wide band emission spectra in the case of the chelates of other ions.

6. Fiduciary documents and liquids requiring authentication, which are authenticated by a marking process as claimed in claim 1.

7. Fiduciary documents and liquids which can be authenticated by a method of marking as claimed in claim 1, wherein the first, the second and the third step of their marking are performed at any time during their manufacture or use.

8. Manual instrument for implementing the method of marking of claim 1, which comprises a storage vessel filled with a solution according to one of the three steps of the marking, communicating with a controlled-flow applicator tip.

9. Instrument as claimed in claim 8, which consists of a felt-tip pen.

10. A method of marking as claimed in claim 1, wherein the chemical reactin produced in step (c) codes the authenticated materials by means of the arrangement of their regions of fluorescent emission and by means of their emission spectra.

11. A method of marking as claimed in claim 1, wherein the chelate is a ligand-rare earth combination.

* * * * *